US006235128B1

(12) United States Patent
Chang et al.

(10) Patent No.: US 6,235,128 B1
(45) Date of Patent: May 22, 2001

(54) CARBON AND ALLOY STEELS THERMOCHEMICAL TREATMENTS

(76) Inventors: John C. Chang, 5133 Andover Ct. SW., Wyoming, MI (US) 49509; John Joseph Krieg, 16 Osage Trail, Spencerport, NY (US) 14559; Richard Blanco Roe, 82 Staglen Dr., Henrietta, NY (US) 14467; Steve Stormzand, 3041 Howlett, Ada, MI (US) 49301; Tony Wu, 3340 Breton Creek, Kentwood, MI (US) 49512; Lynn Lu, 4616 Hunters Ridge Dr. SE., Kentwood, MI (US) 49512; Jeffrey W. Kunitzer, 2456 Brooklyn SE., Grand Rapids, MI (US) 49507

( * ) Notice: Subject to any disclaimer, the term of this patent is extended or adjusted under 35 U.S.C. 154(b) by 0 days.

(21) Appl. No.: 09/264,283

(22) Filed: Mar. 8, 1999

(51) Int. Cl.[7] ..... C22C 8/32

(52) U.S. Cl. ..... 148/219; 148/222; 148/232; 148/218

(58) Field of Search ..... 148/219, 222, 148/233, 232, 218

(56) References Cited

U.S. PATENT DOCUMENTS

| | | | | |
|---|---|---|---|---|
| 1,975,064 | * | 5/1934 | Malcom | 148/16 |
| 3,891,474 | * | 6/1975 | Grange | 148/16.5 |
| 4,119,443 | * | 10/1978 | Abe et al. | 148/12.1 |
| 4,415,378 | * | 11/1983 | McKinney et al. | 148/12.1 |
| 4,622,081 | * | 11/1986 | Stickels et al. | 420/111 |
| 4,719,074 | * | 1/1988 | Tsuno et al. | 419/5 |
| 5,268,040 | * | 12/1993 | Naito et al. | 148/233 |
| 5,707,460 | * | 1/1998 | Chaterjee | 148/218 |
| 5,868,878 | * | 2/1999 | Matossian et al. | 148/565 |

* cited by examiner

*Primary Examiner*—Roy King
*Assistant Examiner*—Nicole Coy
(74) *Attorney, Agent, or Firm*—John R. VanOphem

(57) ABSTRACT

The present invention is a unique sequential process for treating carbon and alloy steels to improve resistance to tribological stresses while reducing conventional processing time required to obtain articles having a similar hardness. This process comprises carburizing or carbonitriding the article, tempering the carburized or carbonitrided article, net-shaping (machining) the tempered article, and plasma (ion) nitriding the tempered article for a significantly reduced period of time versus conventional plasma (ion) nitriding.

15 Claims, No Drawings

CARBON AND ALLOY STEELS THERMOCHEMICAL TREATMENTS

TECHNICAL FIELD

The present invention relates to carbon and alloy steels, and especially relates to thermochemical treatments for carbon and alloy steels.

BACKGROUND OF THE INVENTION

It is well known in the art that various types of treatments of steels can be employed to improve wear resistance, enhancing performance of tribologically stressed steel components, such as those employed in an internal combustion engine. One conventional technique is carbonitriding where the surface of the article becomes enriched with carbon and nitrogen. This process comprises treating the article at elevated temperatures, i.e. about 1550° F. (about 845° C.) to a bout 1700° F. (about 925° C.), with gaseous forms of carbon and nitrogen as is set forth in the ASM Handbook, Volume 4, *Heat Treating*, p. 376–386, ASM International, 1991 (incorporated herein by reference). Conventionally, when this process is employed, an article is carbonitrided, quenched, tempered, and subsequently net shaped. This process typically produces articles having a surface hardness below HV 750 (Vicker Hardness).

Alternatively, plasa (ion) nitriding has been employed to enrich the article's boundary layer with nitrogen, has been employed. In this process, the hardened layer is formed by using glow discharge in a vacuum vessel where nascent nitrogen impinges on the article through plasma bombardment, forming a compound layer, commonly called a white layer, of predominantly gammna prime nitride ($Fe_4N$). (see ASM Handbook, Volume 4, *Heat Treating*, p.420, ASM International, 1991 (incorporated herein by reference)). When this process is employed, the article is typically treated at lower temperatures than carbonitriding, i.e. about 840° F. (about 450° C.) to about 975° F. (about 525° C.), for an extended period of time which typically reaches or exceeds about twenty-four (24) hours. The layer formed by this process typically has a hardness of HV 700, with greater than HV 1200 in the compound layer.

What is needed in the art is a process for forming wear resistant articles in a reduced processing time.

SUMMARY OF THE INVENTION

The present invention relates to a unique treatment process for carbon and alloy steel articles. This process comprises: fabricating the article into a desired shape; carbonitriding the fabricated article; tempering the carbonitrided article; and plasma nitriding the tempered article.

The above discussed and other features and advantages of the present invention will be appreciated and understood by those skilled in the art from the following detailed description.

DESCRIPTION OF THE PREFERRED EMBODIMENT

The present invention is a unique sequential process for forming a steel article comprising: fabricating the article, carburizing and/or carbonitriding the article to produce a treated article, tempering the treated article, optionally net-shaping the tempered article, and plasma (ion) nitriding the net-shaped article.

The article is produced via conventional fabricating processes to, preferably, closely meet the article's tolerance requirements, and then heat treating the article to adjust the mechanical properties.

Once fabricated, the article can be carburized or carbonitried. Both of these processes comprise heating the article in an enclosure such as a furnace, to a sufficient temperature and inducing gaseous carbon, or gaseous carbon and nitrogen to diffuse into the surface of the article, typically about 1,550° F. to about 1,700° F. (about 845° C. to about 925° C.). This process is continued for a sufficient period of time to obtain the desired depth of the carbon or carbon/nitrogen layer; typically up to about 4 hours. The desired layer depth, which is based upon the specific application of the article, is obtained via the interdependent properties of temperature, gas concentration, and duration of heating. The desired depth of the carbon or carbon/nitrogen rich layer is typically up to or exceeding about 0.75 millimeter (mm), with up to about 0.50 mm preferred.

The gaseous carbon atmosphere is adjusted according to the iron-carbon equilibrium diagram (carbon absorption by iron versus temperature) for suitable solubility of the carbon in the austentite solution of the subject article, with about 0.50 to about 0.95 weight percent (wt %) of carbon absorption into the article preferred, while nitrogen absorption of up to 0.5 wt % is preferred. The desired relative amounts of carbon and nitrogen is based upon the desired composition at the surface of the article.

While heating, a gaseous mixture of endothermic gases and enriching gases is introduced to the enclosure containing the article. The endothermic gas generally comprises those derived (typically via reaction with air) from natural gas, methane, butane and/or propane, including, but are not limited to, gaseous nitrogen, hydrogen, carbon dioxide, carbon monoxide, water and methane, among others, with a typical gaseous composition comprising 40% nitrogen gas, 40% hydrogen gas, 20% carbon monoxide gas, with enriching gases of ammonia, natural gas, propane, methane, and/or butane. Note, other carbon and/or nitrogen containing gases and mixtures thereof, can be employed with the present invention. The relative amounts of the various gases employed in the mixture is based upon the carbon potential needed in the atmosphere to achieve the desired 0.50 to 0.95 weight percent (wt %) carbon absorption into the article. This carbon potential is controlled by an adequate carbon dioxide:carbon monoxide ratio, as set forth in ASM Handbook, Volume 4, *Heat Treating*, p. 317, ASM International, 1991 (pages 312–324 are hereby incorporated by reference).

After the article has been carburized or carbonitrided, it is cooled or quenched, preferably to near room temperature. The cooling rate of the article should be sufficient to allow the formation of a mixture of microstructure containing martensite and retained austentite, with the amount of retained austenite possibly being up to about 50%, depending on carbon and nitrogen content in the enriched case. The surface hardness of this article can attain about HV 653 or greater.

After the article has been carburized/carbonitrided and quenched, it is tempered to reduce internal stresses. Rapid cooling and absorption of carbon and nitrogen during carbonitriding cause volume change and internal stresses in the article. A suitable tempering temperature allows relaxation of such internal stresses and a reaching of an equilibrium state of volume stability for the subsequent plasma (ion) nitriding process. Consequently, the article is preferably heated to about 250° F. to about 960° F. (about 120° C. to about 515° C.) for up to about 2.0 hours, although other times and temperatures can be employed.

Once tempered the article is preferably "net-shaped", by machining or otherwise processing, to the desired specification. This process forms the article to the final dimensions, correcting for any dimensional changes which may have resulted from the carburizing/carbonitriding and tempering processes. Possible net-shaping processes include, but are not limited to, machining, grinding, surface finishing, honing, tumbling, among others.

In order to improve the tribological success of the article, it is subsequently subjected to plasma (ion) nitriding. Plasma (ion) nitriding essentially comprises: heating the article in a vacuum enclosure, introducing nitrogen and hydrogen gases to the enclosure, and maintaining a load at a high negative direct current potential, exceeding about 600 volts (V), with respect to the grounded enclosure. Under the influence of this voltage, the nitrogen gas is ionized, an accelerated toward the article which functions as a cathode. Upon impact with the article, the nitrogen absorbs into the article to forming a compound layer up to about 20 microns deep, of predominantly a gamma prime nitride (Fe4 N) microstructure. The hardness in this compound layer could reach or exceed about 1200 HV. The period of time for the plasma (ion) nitriding process utilized to obtain such a hardness can be less than about 12 hours, with less than about 6.0 hours preferred, and less than about 5.0 hours especially preferred, for reasons of efficiency and economy.

The load maintained during the plasma (ion) nitriding should be sufficient to ionize the nitrogen, with a load of about 400 V to about 1200 V, typically employed, while a temperature of about 840° F. (about 450° C.) to about 975° F. (about 525° C.) is also typically employed. Additional description of a plasma (ion) nitriding process is described in ASM Handbook, Volume 4, *Heat Treating*, pp. 420–424, ASM International, 1991 (hereby incorporated by reference).

The present invention produces improved carbon and alloy steel articles in a simplified process which enables relaxed requirements. The process of the present invention forms durable layers comprising up to and even exceeding about 50% austenite, while conventional articles having large amounts of austenite typically experienced early failure due to spalling. The articles of the present invention possess a surface hardness exceeding about HV 800, while conventional carburizing/carbonitriding articles have a surface hardness of typically below 750 HV, and typically below 650 HV.

In addition to relaxing article requirements and producing an article having an improved surface hardness, the present invention reduces the overall processing time versus conventional processes capable of attaining a similar hardness for hardening article surfaces. For example, the overall process of the present invention can be completed in less than about 20 hours, and typically completed in less than about 12 hours, while a conventional plasma (ion) nitriding process which produces a similar compound layer hardness typically takes over 24 hours to complete.

EXAMPLE

The following example, which is meant to be exemplary, not limiting, produced improved alloy steel articles for high stress wear application; namely a direct acting hydraulic valve lifter and cam interface in a combustion engine.

Low alloy steel direct acting hydraulic valve lifter and cam parts were processed by carburizing (Sample 1) and carbonitriding (Sample 2) for 4 hours, separately, at 1575° F. and in an environment of having nitrogen gas and hydrogen gas, with 18–20 volume percent (vol %) carbon monoxide gas and 0.28–0.34 vol % carbon dioxide, and for the carbonitriding process, an additional 2.5 vol % ammonia enriching gas was used, for a nominal 0.55 mm effective case depth on the cam contact surface. All parts were subsequently oil quenched, and tempered at 300° F. for 1 hour. The retained austenite was measured through X-ray diffraction at a retention level of 15% for Sample 1 and 40% for Sample 2. Subsequent net-shaping processes including outer diameter grinding, and foot shaping were then performed. Once net-shaped, Samples 1 and 2 were plasma (ion) nitride heat treated at 880° F. to 905° F. for 4.5 hours in an environment comprising 35 vol % nitrogen gas and 65 vol % hydrogen gas. The compound layer (white layer) was measured at 7–9 microns thick on the cam contact surface. Both of these Samples exhibited a hardness level of HV 630 at a 0.05 mm case depth, and HV 1200 in the compound layer.

A group of carburized parts (Sample 3) where formed in a similar fashion as above: carburizing for 4 hours at 1575° F. and in an environment of nitrogen gas and hydrogen gas, with 18–20% carbon monoxide gas and 0.28–0.34 vol % carbon dioxide, for a nominal 0.55 mm effective case depth on the cam contact surface; oil quenched; tempered at 300° F. for 1 hour; and net-shaped. The retained austenite was measured through X-ray diffraction at a 15% retention level. This Sample exhibited a hardness level of HV 720 at a 0.05 mm case depth.

In an engine durability test, the two group parts from the present invention (Samples 1 and 2) were tested side-by-side with the group of conventionally carburized parts (Sample 3). The final results showed that: both Sample 1 and 2, processed according to the present invention, performed equally, and out performed Sample 3, the conventionally carburized group parts. Sample 3 exhibited twice as much microspalling wear on the cam contact surface; such spalling leads to catastrophic failure.

What is claimed is:

1. A method for forming a hard surface on a steel article, comprising:

carbonitriding the article;

tempering said carbonitrided article; and nitriding said tempered article.

2. A method as in claim 1, wherein said article has a surface hardness exceeding about 1200 HV.

3. A method as in claim 1, wherein said tempering comprises heating said carbonitrided article to about 250° F. to about 960° F.

4. A method as in claim 3, wherein said carbonitrided article is tempered for a period of up to about 2 hours.

5. A method as in claim 1, further comprising net-shaping said tempered article prior to said nitriding.

6. A method as in claim 1, wherein said tempered article is nitrided for a period of less than about 12 hours.

7. A method as in claim 1, wherein said tempered article is nitrided for a period of less than about 6 hours.

8. A method as in claim 1, wherein said tempered article is nitrided for a period of less than about 5 hours.

9. A method as in claim 8, wherein said article has a surface hardness exceeding about 1200 HV.

10. A method as in claim 1, wherein said carbonitriding, tempering, and nitriding are completed in a period of time of about 20 hours or less.

11. A method as in claim 1, wherein said carbonitriding, tempering, and nitriding are completed in a period of time of about 12 hours or less.

12. A method as in claim 1, wherein said nitriding, comprises:

a) placing the tempered article in an enclosure;

b) introducing process gas containing nitrogen to the enclosure;

c) maintaining a load with respect to the enclosure;

d) ionizing the nitrogen; and e) absorbing the nitrogen into the tempered article.

13. A method as in claim 12, wherein said article has a surface hardness exceeding about 1200 HV.

14. A method as in claims 12, wherein said tempered article is nitrided for a period of less than about 5 hours.

15. A method as in claim 12, wherein said article has a surface hardness exceeding about 1200 HV.

* * * * *